US007109428B2

(12) United States Patent
Galvin et al.

(10) Patent No.: US 7,109,428 B2
(45) Date of Patent: Sep. 19, 2006

(54) ROCKING OPERATION TYPE ELECTRIC COMPONENT

(75) Inventors: Michael Galvin, Miyagi-ken (JP); Chieko Ito, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 11/224,835

(22) Filed: Sep. 12, 2005

(65) Prior Publication Data

US 2006/0054475 A1 Mar. 16, 2006

(30) Foreign Application Priority Data

Sep. 14, 2004 (JP) ..... 2004-267210

(51) Int. Cl.
*H01H 9/00* (2006.01)

(52) U.S. Cl. ..... 200/5 R; 200/1 B; 200/339

(58) Field of Classification Search ..... 200/5 R, 200/5 A, 1 R, 6 R, 18, 553, 329, 339
See application file for complete search history.

(56) References Cited

U.S. PATENT DOCUMENTS 5,414,231 A * 5/1995 Sato et al. ..... 200/1 R
5,669,487 A * 9/1997 Sakata ..... 200/339
5,719,361 A * 2/1998 Lee ..... 200/1 B
5,902,972 A * 5/1999 Nestor et al. ..... 200/1 B
6,191,372 B1 * 2/2001 Sasaki et al. ..... 200/1 R
6,528,742 B1 * 3/2003 Serizawa et al. ..... 200/5 R

FOREIGN PATENT DOCUMENTS

JP 8-264073 10/1996
JP 9-259703 10/1997

* cited by examiner

*Primary Examiner*—Kyung Lee
(74) *Attorney, Agent, or Firm*—Brinks Hofer Gilson & Lione

(57) ABSTRACT

A rocking operation type electric component is presented that includes: an operation knob that has a bottomed case-shaped configuration and is rockably held; a signal generating unit that includes a movable element pressed and driven by the operation knob and generates a different electric signal in response to a position change of the movable element; and a case on which a mounting frame for pivotally supporting the operation knob is protrusively provided formed and in which the signal generating unit is received. A pair of rotation shafts which face each other are protrusively formed on inner wall portions of the operation knob, respectively. Through-holes are respectively formed in a pair of wall portions of the mounting frame which face each other. The rotation shafts are fitted into the through-holes from the outside of the mounting frame to be rotatably supported by the mounting frame.

2 Claims, 3 Drawing Sheets

ROCKING OPERATION TYPE ELECTRIC COMPONENT

This application claims the benefit of priority to Japanese Patent Application No. 2004-267210, filed on Sep. 14, 2004, herein incorporated by reference.

BACKGROUND OF THE INVENTION

1. Field of the Invention

The present invention relates to a rocking operation type electric component, such as a switch device, a variable resistor and the like, in which an operation knob is rocked (seesawed), and more particularly, to a mounting structure of the operation knob.

2. Description of the Related Art

Generally, a rocking operation type electric component, which serves, for example, as a switch device applied to a power window mechanism for a vehicle, includes an operation knob which can be rocked and has a bottomed case-shaped configuration, a signal generating unit which includes a movable element to be pressed and driven by the operation knob and generates a different electric signal in response to a position change of the movable element, and a case which receives the signal generating unit. The operation knob is rotatably mounted on a portion of the case.

FIG. 5 is an explanatory view illustrating an exemplary mounting structure of an operation knob in this kind of conventional electric component (for example, see Japanese Unexamined Patent Application Publication No. 9-259703 (page 2 and FIG. 6)). Referring to FIG. 5, in a bottomed case-shaped operation knob 50, a pair of rotation shafts 53 and 54 protrude outwards from left and right side walls 51 and 52, respectively. The operation knob 50 is inserted between a pair of wall portions 55 and 56 of a case which face each other. The wall portions 55 and 56 are provided with through-holes 55*a* and 56*a*, respectively. By outwardly fitting the rotation shafts 53 and 54 from the inside of the case into the through-holes 55*a* and 56*a*, respectively, the operation knob 50 is rotatably assembled with the case. At this time, a widthwise dimension of the operation knob 50 including the rotation shafts 53 and 54 is established to be slightly larger than a gap between the pair of wall portions 55 and 56 of the case. When assembling the operation knob 50 to the case, the operation knob 50 is inserted between the wall portions 55 and 56 with the side walls 51 and 52 elastically bent inward, and then, the rotation shafts 53 and 54 are snap-fitted into the corresponding through-holes 55*a* and 56*a*. By this fact, the operation knob 50 is rotatably supported by the wall portions 55 and 56 of the case. Therefore, by controlling the rotation of the operation knob 50 within a predetermined angle, the operation knob 50 can be rocked.

In another conventional exemplary construction, shafts are respectively formed on a pair of wall portions of a case which face each other, in such a way as to protrude outward. A pair of side walls of an operation knob are provided with installation holes into which the shafts can be fitted, respectively. The wall portions of the case are inserted between the pair of side walls of the operation knob, and the shafts of the case are respectively snap-fitted into the corresponding installation holes of the operation knob. By this fact, the operation knob is rotatably mounted on the wall portions of the case.

In the conventional rocking operation type electric component shown in FIG. 5, since the operation knob 50 is inserted to rock between the wall portions 55 and 56 of the case and the through-holes 55*a* and 56*a* into which the rotation shafts 53 and 54 are fitted are exposed to the outside, if liquid such as rain water or beverage adheres to the exposed surface of the operation knob 50 or the case, the liquid is likely to leak into the case through a gap between the wall portions 55 and 56 and the side walls 51 and 52 or a gap between the through-holes 55*a* and 56*a* and the rotation shafts 53 and 54. In this regard, because a signal generating unit including contact portions is arranged inside the case, if the liquid leaking into the case from the outside adheres to the signal generating unit, a short circuit or corrosion of the signal generating unit can be caused, and operational reliability of the rocking operation type electric component can be degraded. Further, because the rotation shafts 53 and 54 of the operation knob 50 are viewed from the outside, the design or the outer appearance of the rocking operation type electric component may be deteriorated.

Also, in the latter example, because the operation knob is installed to cover the pair of wall portions of the case which face each other, it is possible to accomplish a structure for preventing to some extent liquid such as rain water or beverage from leaking into the case. However, due to the fact that the installation holes of the operation knob into which the shafts of the case are snap-fitted are exposed to the outside, the possibility of liquid to leak into the case through the gap between the installation holes and the shafts still exists. Accordingly, leakage of liquid is not completely prevented. Also, because it is the norm that the operation knob has a strength which is no greater than that of the case, when adopting the structure in which the shafts of the case are snap-fitted into the installation holes of the operation knob, a mechanical strength is insufficient around the installation holes of the operation knob, and therefore, the operation knob is likely to be broken around the installation holes. Moreover, even in this conventional example, since the installation holes of the operation knob and the shafts of the case are viewed from the outside, the design or the outer appearance of the rocking operation type electric component is deteriorated.

SUMMARY OF THE INVENTION

Accordingly, the invention has been made to solve the above-mentioned problems, and it is an object to a rocking operation type electric component which can prevent ingress of liquid, secure a mechanical strength of an operation knob, and provide an aesthetic outer appearance.

In order to achieve the above object, according to an aspect of the invention, there is provided a rocking operation type electric component including an operation knob that has a bottomed case-shaped configuration and is rockably held; a signal generating unit that has a movable element pressed and driven by the operation knob and generates a different electric signal in response to a position change of the movable element; and a case on which a mounting frame for pivotally supporting the operation knob is protrusively formed and in which the signal generating unit is received. In the rocking operation type electric component, a pair of rotation shafts which face each other are protrusively formed on inner wall portions of the operation knob, through-holes are respectively provided in a pair of wall portions of the mounting frame which face each other, and the rotation shafts are fitted into the through-holes from the outside of the mounting frame to be rotatably supported by the mounting frame.

Due to the fact that the mounting frame which is protrusively formed on the case has the pair of through-holes and the rotation shafts of the operation knob are respectively snap-fitted into the through-holes from the outside of the mounting frame, the operation knob which is rotatably supported by the mounting frame can cover the mounting frame, and the rotation shafts and the through-holes are not exposed to the outside. Therefore, when liquid such as rain water or beverage adheres to the case or the operation knob, the possibility of the liquid to leak into the case is significantly reduced. In addition, a short circuit or corrosion of the signal generating unit due to ingress of the liquid can be prevented, whereby operational reliability of the rocking operation type electric component can be ensured. Also, since the rotation shafts formed on the operation knob are fitted into the through-holes formed in the case which has a greater strength than the operation knob, when compared with a mounting structure in which shafts formed on a case are fitted into holes defined in an operation knob, it is easy to secure a mechanical strength of the operation knob. Moreover, since the rotation shafts of the operation knob and the through-holes of the mounting frame are not exposed to the outside, an aesthetic outer appearance of the rocking operation type electric component can be provided.

In the above construction, it can be envisaged that two mounting frames, which are located in parallel with surfaces having the through-holes adjacent each other, and a partition wall, which is located between the two mounting frames, are protrusively formed on the case; and, at an opened end of the operation knob, a side wall facing the partition wall has a tapered portion that a front end portion gradually decreases in its thickness and a gap between the partition wall and the front end portion of the side wall of the operation knob gradually decreases. Therefore, when an unintentional force is applied to the operation knob such as when an elbow of an operator comes into contact with the operation knob, due to the presence of the partition wall, mis-operation of the operation knob can be prevented, whereby safety can be improved. Further, even when a gap between operation knobs which are installed parallel to each other is decreased, due to the presence of the partition wall, it is possible to clearly distinguish the respective operation knobs through a finger's touch. Therefore, a rocking operation type electric component which can be appropriately applied to a power window mechanism for a vehicle can be obtained. Meanwhile, when snap-fitting the operation knob into the mounting frame, the side walls of the operation knob which have the rotation shafts are elastically bent outward. In this regard, since the side wall of the operation knob which faces the partition wall is formed with the tapered portion and this tapered portion does not substantially increase the widthwise size of the operation knob even when the corresponding side wall is bent outward during installation of the operation knob, the gap between the partition wall and the side wall of the operation knob which faces the partition wall can be remarkably decreased, whereby it is possible to simply and reliably install the operation knob on the mounting frame and accomplish miniaturization of the entire electric component.

Furthermore, in the above construction, while it is possible to constitute a rocking operation type variable resistor by placing resistors, sliders, and so forth in the signal generating unit, in the case that the signal generating unit includes a plurality of movable contacts which are driven by the movable element and a plurality of fixed contacts to and from which the movable contacts can be connected and disconnected, an operation switch which is appropriate to a power window mechanism for a vehicle can be obtained.

DESCRIPTION OF THE PREFERRED EMBODIMENT

Figure 1:
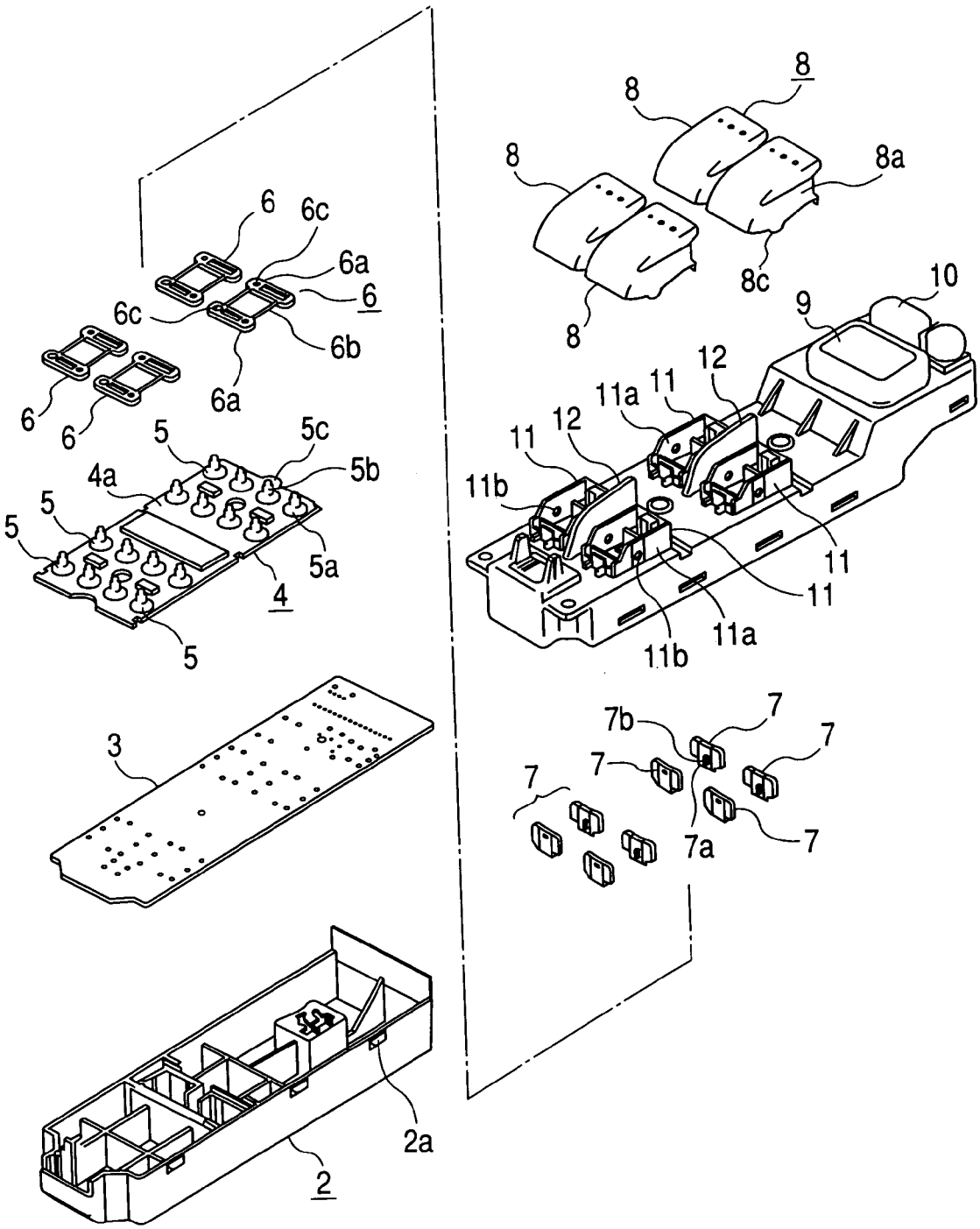
FIG. 1 is an exploded perspective view illustrating a switch device according to an embodiment of the present invention.
Figure 2:
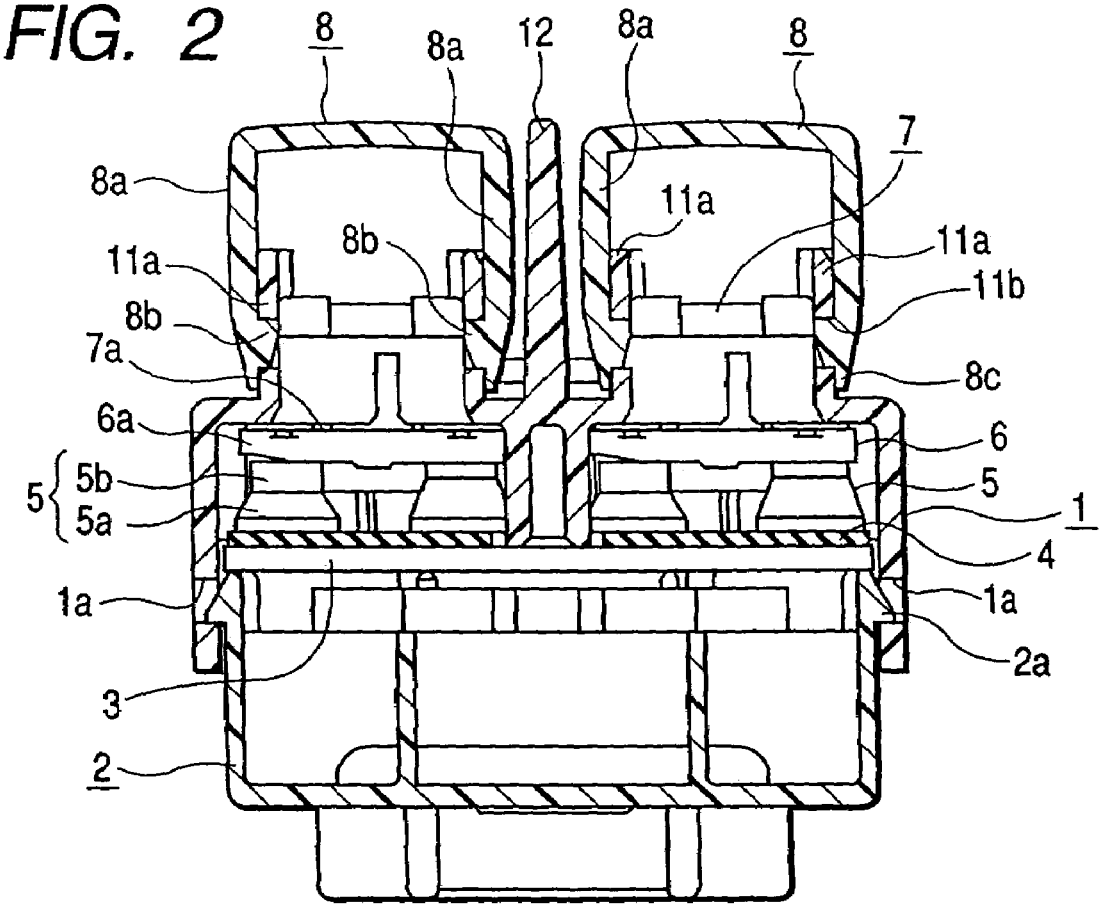
FIG. 2 is a cross-sectional view of the switch device shown in FIG. 1.
Figure 3:
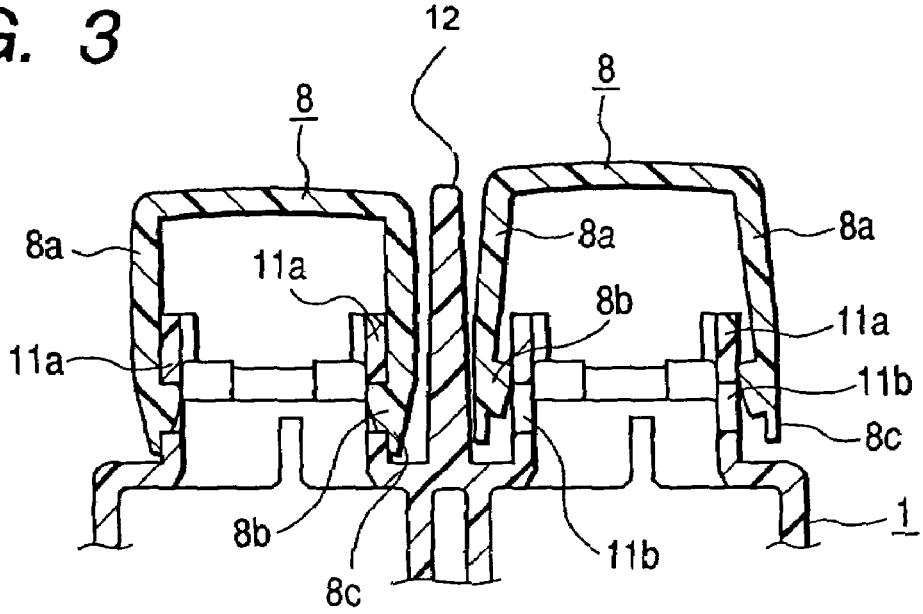
FIG. 3 is an explanatory view illustrating an assembling process for installing an operation knob of the switch device.
Figure 4:
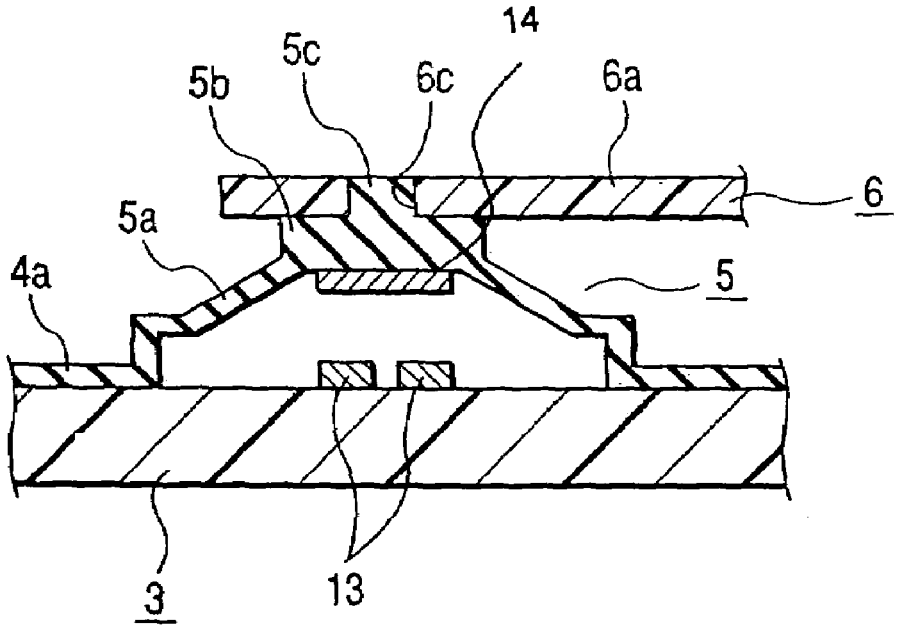
FIG. 4 is an explanatory view illustrating a structure of contact portions of the switch device.
Figure 5:
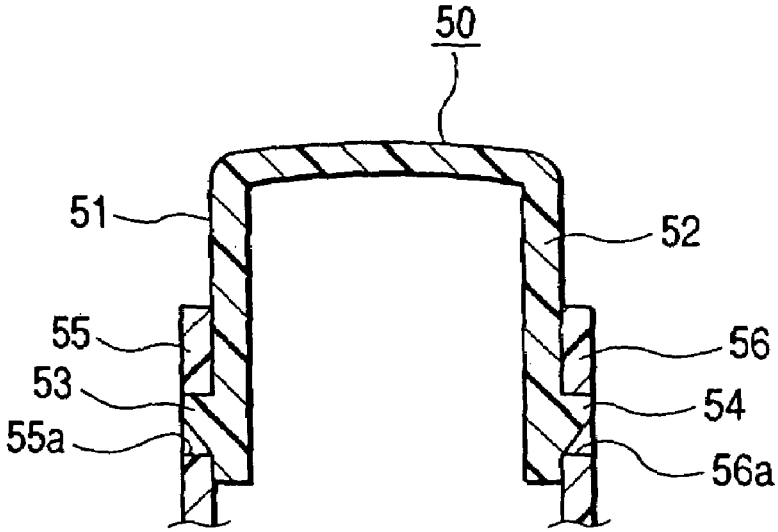
FIG. 5 PRIOR ART
FIG. 5 is an explanatory view illustrating an installation structure of an operation knob according to the related art.

Hereafter, a preferred embodiment of the present invention will be described with reference to the accompanying drawings. FIG. 1 is an exploded perspective view illustrating a switch device according to an embodiment of the present invention, FIG. 2 is a cross-sectional view of the switch device shown in FIG. 1, FIG. 3 is an explanatory view illustrating an assembling process for installing an operation knob of the switch device, and FIG. 4 is an explanatory view illustrating a structure of contact portions of the switch device.

A switch device according to the present embodiment is applied to an operation switch of a power window mechanism for a vehicle. The switch device mainly includes an upper case 1 and a lower case 2 which constitutes a casing, a circuit board 3 which is disposed in the casing, a click rubber 4 which is mounted on the circuit board 3 and has a plurality of hollow protrusions 5, cam members 6 which are placed on the plurality of hollow protrusions 5 in a horizontal direction, sliders 7 for pressing the cam members 6, four operation knobs 8 which are mounted on the upper case 1, and large-sized and small-sized operation elements 9 and 10.

Four mounting frames 11 are protrusively provided on the upper surface of the upper case 1 so as to correspond to the respective operation knobs 8. A partition wall 12 is protrusively provided on the upper case 1 between two mounting frames 11 which are disposed so as to be adjacent to each other. All the mounting frames 11 have the same shape and size. A pair of through-holes 11*b* are provided in a pair of wall portions 11*a* opposite to each other such that the respective operation knobs 8 are pivotally supported to rock. A gap between the partition wall 12 and each of the mounting frames 11 located at both sides of the partition wall 12 is set to be small, and therefore, a gap between the partition wall 12 and the operation knob 8 mounted on the mounting frame 11 is set to be further smaller. However, although the gap between the mounting frame 11 and the partition wall 12 is small, the through-hole 11*b* can be easily provided in the mounting frame 11 using a slide core, etc. A plurality of locking grooves 1*a* are defined on the side surfaces of the upper case 1, and a plurality of locking protrusions 2*a* are formed on the side surfaces of the lower case 2. By engaging the locking protrusions 2*a* into the corresponding locking grooves 1*a*, the upper case 1 and the lower case 2 are integrally assembled with each other.

A circuit pattern (not shown) which includes a plurality of fixed contacts 13 (see FIG. 4) is formed on the circuit board 3, and various electronic components (not shown) including an LED, a capacitor, and the like are mounted on the circuit board 3.

The click rubber 4 is an integrally molded product which has a flat plate portion 4*a* provided on the circuit board 3 and the plurality of hollow protrusions 5 erected on the flat plate portion 4*a*. The hollow protrusions 5 are disposed at locations that correspond to the fixed contacts 13, respectively. As shown in FIG. 4, each hollow protrusion 5 has an elastic deformation portion 5*a* which extends from the flat plate portion 4*a* and has a dome-shaped configuration, a stem 5*b* which lids the upper end of the elastic deformation portion 5*a* and has a circular column-shaped configuration, and a convex portion 5*c* which protrudes upward substantially from the center portion of the stem 5*b*. A movable contact 14 which can be connected to and disconnected from the fixed contact 13 is provided on the bottom surface of the stem 5*b*. While the hollow protrusions 5 have the same height, two kinds of hollow protrusions 5 which have slightly different shapes are alternately disposed. In one kind of hollow protrusions 5, the convex portions 5*c* have a large diameter and the stems 5*b* have a small height. In the other kind of hollow protrusions 5, the convex portions 5*c* have a small diameter and the stems 5*b* have a large height. For this reason, when compared with the former kind of hollow protrusions 5, in the latter kind of hollow protrusions 5, an operation stroke for contacting the movable contact 14 with the fixed contact 13 is shortened. However, the two kinds of hollow protrusions 5 have the same basic constructions.

Each cam member 6 has a pair of pressure receiving portions 6*a* each of which rides on two adjacent hollow protrusions 5 in the horizontal direction to receive a pressure from the operation knob 8. The pair of pressure receiving portions 6*a* are connected to each other by a pair of bridging portions 6*b* which have a thin, long and slim configuration. Large and small fitting holes 6*c* are respectively formed at both ends of each pressure receiving portion 6*a*. The convex portions 5*c* of the hollow protrusions 5 are forcefully fitted into the respective fitting holes 6*c* by pressing. That is, the convex portion 5*c* of one hollow protrusion 5 which has a large diameter is forcefully fitted into the fitting hole 6*c* which is defined at one end of the pressure receiving portion 6*a* and has a large diameter, and the convex portion 5*c* of the other hollow protrusion 5 which has a small diameter is forcefully fitted into the fitting hole 6*c* which is defined at the other end of the pressure receiving portion 6*a* and has a small diameter. By this fact, the pressure receiving portion 6*a* can be horizontally held by the two adjacent hollow protrusions 5, and the pressure from the operation knob 8 can be transmitted to the hollow protrusions 5 through the pressure receiving portion 6*a*. However, since the pair of bridging portions 6*b* have sufficient elasticity, the pair of pressure receiving portions 6*a* that constitute the cam member 6 can be operated independently.

The sliders 7 serve as pressing pieces which are assembled with the upper case 1 to be raised and lowered and which are mounted between the pressure receiving portions 6*a* and the operation knob 8. A pressing protuberance 7*a* which is brought into contact with the pressure receiving portion 6*a* of the cam member 6 is formed on the lower surface of each slider 7, and a position determining protuberance 7*b* is formed on the side surface of each slider 7. Also, while not shown in the drawings, a plurality of slot-like spaces into which the sliders 7 are respectively accommodated are defined on the bottom portion of the upper case 1. At a side of each space, a guide groove is formed in the upper case 1. With the position determining protuberance 7*b* inserted into the guide groove, the slider 7 can be disposed to be raised and lowered in the space. Accordingly, since each slider 7 is precisely assembled at a predetermined location in the upper case 1, the slider 7 is prevented from being inclined while being raised and lowered. The pressing protuberance 7*a* of each slider 7 is brought into contact with the pressure receiving portion 6*a* not at a central position but at an eccentric position on the pressure receiving portion 6*a*. Specifically, the pressing protuberance 7*a* of each slider 7 is brought into contact with a portion of the pressure receiving portion 6*a* which is adjacent to the fitting hole 6*c* having a small diameter (remote from the fitting hole 6*c* having a large diameter). For this reason, when the slider 7 is lowered by being pressed by the operation knob 8, between the elastic deformation portions 5*a* of the two kinds of hollow protrusions 5 on which the pressure receiving portion 6*a* rides in a horizontal direction, rather than the elastic deformation portion 5*a* of one hollow protrusion 5 of which convex portion 5*c* has a large diameter and which has a relatively long operation stroke, the elastic deformation portion 5*a* of the other hollow protrusion 5 of which convex portion 5*c* has a small diameter and which has a short operation stroke is first buckled by the slider 7.

The operation knob 8 includes a molded product which has a bottomed case-shaped configuration and which is opened at the lower end thereof. In the operation knob 8, a pair of rotation shafts 8*b* are respectively formed on the inner wall surfaces of a pair of side walls 8*a* which are substantially parallel to each other. The pair of rotation shafts 8*b* protrude toward each other. The pair of rotation shafts 8*b* are respectively snap-fitted from the outside into the pair of through-holes 11*b* defined through the pair of wall portions 11*a* of each mounting frame 11 of the upper case 1 which face each other. In this way, the operation knob 8 is supported by the wall portions 11*a* to rock, while covering the mounting frame 11. The lower end portion of each of the side walls 8*a* of the operation knob 8 has a tapered portion 8*c* whose front end portion gradually decreases in thickness and whose outer wall has an inclined surface. Therefore, as the tapered portion 8*c* of the side wall 8*a* which faces the partition wall 12 gradually increases a gap between the partition wall 12 and the side wall 8*a* at the lower end portion of the side wall 8*a*, a space required for allowing the passage of the side wall 8*a* when installing the operation knob 8 can be secured between the partition wall 12 and the side wall 8*a*. Speaking in detail, when snap-mounting the operation knob 8 to the mounting frame 11, the side walls 8*a* which have the rotation shafts 8*b* must be elastically bent outward. In the case of the side wall 8*a* which is opposite to the partition wall 12, if the gap between the partition wall 12 and the side wall 8*a* is increased to allow bending of the side wall 8*a*, a widthwise dimension of the upper case 1 is unwantedly increased. Therefore, by forming the tapered portion 8*c* on the lower end portion of the side wall 8*a* and defining the space for allowing the passage of the side wall 8*a*, when the side wall 8*a* is bent to a required degree during installation of the operation knob 8 as shown in FIG. 3, the side wall 8*a* is not brought into contact with the partition wall 12. Also, while not shown in the drawings, a plurality of driving protuberances are formed on the lower surface of the bottoming wall portion of the operation knob 8 to protrude downward. The driving protuberances are positioned above the two sliders 7 which correspond to the pair of pressure receiving portions 6*a* of the cam member 6, so that the respective sliders 7 can be selectively pressed downward. In other words, if the operation knob 8 is rocked in one direction, one slider 7 is pressed downward and lowered, and if the operation knob 8 is rocked in the reverse direction, the other slider 7 is pressed downward and lowered.

When assembling the switch device constructed as mentioned above, by forcefully fitting the convex portions 5*c* of the hollow protrusions 5 into the fitting holes 6*c* of the pressure receiving portions 6*a*, the cam members 6 are mounted on the click rubber 4. Thereafter, with the click rubber 4 placed on the circuit board 3, the circuit board 3 is received and fixed in the lower case 2. Then, the operation knobs 8 and the operation elements 9 and 10 are mounted on the upper surface of the upper case 1, and the sliders 7 are fitted into the upper case 1. Thereupon, by engaging the locking protrusions 2*a* into the locking grooves 1*a*, the upper case 1 and the lower case 2 are integrally assembled with each other.

Hereafter, the operation of the switch device according to the present invention will be described. When not operated, since the operation knob 8 does not downwardly press the sliders 7, no pressing force is transmitted from the operation knob 8 to the pressure receiving portion 6*a* which rides on the two adjacent hollow protrusions 5 in the horizontal direction, and the pressure receiving portion 6*a* is horizontally maintained by the two adjacent hollow protrusions 5. In this state, as shown in FIG. 2, the elastic deformation portions 5*a* of the respective hollow protrusions 5 are not buckled, and therefore, the movable contacts 14 are separated from the fixed contacts 13, which results in a switch-off state.

In this state, if an operator implements rocking operation by rotating the operation knob 8 in one direction, since a slider 7 positioned at a side on which the driving protuberances are lowered is pressed downward, the corresponding slider 7 presses the pressure receiving portion 6*a*. As a consequence, the elastic deformation portion 5*a* of the hollow protrusion 5 which has a short operation stroke is first buckled, and as the movable contact 14 of the corresponding hollow protrusion 5 is brought into contact with the corresponding fixed contact 13, a first switch-on signal is outputted. This switch-on signal is used as a driving signal for operating a window in an opening direction. At this time, because click feeling which is produced when the hollow protrusion 5 is buckled is transmitted to the operation knob 8, the operator can perceive through a finger the fact that on-operation for opening the window has been implemented.

Thereafter, if an operation force applied to the operation knob 8 is removed, since the elastic deformation portion 5*a* of the hollow protrusion 5 which is maintained in the buckled state returns to its original dome-shaped configuration, the pressure receiving portion 6*a* which rides on the hollow protrusion 5 is biased upward, and the slider 7 moves upward. As a result, the operation knob 8 automatically returns to its non-operation posture, and the movable contact 14 which is arranged in the corresponding hollow protrusion 5 is separated from the fixed contact 13 to return to the switch-off state.

Instead of removing the operation force, if rocking operation is implemented to further rotate the operation knob 8 in one direction, since the pressure receiving portion 6*a* which is inclined by buckling the hollow protrusion 5 having a short operation stroke is further pressed downward by the slider 7, the end of the pressure receiving portion 6*a* which end is remote from the buckled hollow protrusion 5 presses downward the other hollow protrusion 5 which is positioned directly below the corresponding end of the pressure receiving portion 6*a* and which has a long operation stroke, to buckle the elastic deformation portion 5*a* of the other hollow protrusion 5. By this fact, since the movable contacts 14 installed in the two adjacent hollow protrusions 5 on which the pressure receiving portion 6*a* rides in the horizontal direction are brought into contact with their corresponding fixed contacts 13, a second switch-on signal is outputted. This switch-on signal is used as a driving signal for opening all windows. At this time, because click feeling which is produced when the hollow protrusion 5 having a long operation stroke is buckled is transmitted to the operation knob 8, the operator can perceive through a finger the fact that on-operation for opening all windows has been implemented.

After on-operation for opening all windows is implemented in this way, if the operation force applied to the operation knob 8 is removed, since the elastic deformation portions 5*a* of the two adjacent hollow protrusions 5 which are maintained in the buckled state return to their dome-shaped configurations, the pressure receiving portion 6*a* which rides on the two adjacent hollow protrusions 5 in the horizontal direction is biased upward, and the slider 7 moves upward. As a result, the operation knob 8 automatically returns to its non-operated posture, and the movable contacts 14 which are installed in both hollow protrusions 5 are separated from their corresponding fixed contacts 13 to return to the switch-off state.

The operation of the switch device when the operation knob 8 which is maintained in a non-manipulated state is rotatably manipulated in the other direction is implemented in the same manner as described above. Namely, since it is possible to buckle one hollow protrusion 5 having a short operation stroke through rocking operation for initially rotating the operation knob 8, following the buckling of the corresponding hollow protrusion 5, a third switch-on signal which is used as a driving signal for operating the window in a closing direction can be outputted. Then, if the operation force is removed, the operation knob 8 automatically returns to its initial state. Also, if the rocking operation is implemented to further rotate the operation knob 8 in the other direction, since it is possible to buckle not only one hollow protrusion 5 having a short operation stroke but also the other hollow protrusion 5 having a long operation stroke, following the buckling of both hollow protrusions 5, a fourth switch-on signal which is used as a driving signal for closing all windows can be outputted. Thereupon, if the operation force is removed, the operation knob 8 automatically returns to its initial state.

As is apparent from the above description, in the switch device according to the present invention, due to the fact that the facing wall portions 11*a* of the mounting frame 11 which is protrusively formed on the upper case 1 have the pair of through-holes 11*b* and the rotation shafts 8*b* of the operation knob 8 are respectively snap-fitted into the through-holes 11*b* from the outside of the mounting frame 11, the operation knob 8 is rotatably supported by the wall portion 11*a* while covering the mounting frame 11, and the rotation shafts 8*b* and the through-holes 11*b* are not exposed to the outside. Therefore, when liquid such as rain water or beverage adheres to the operation knob 8 or its surrounding portions, the possibility of the liquid to leak into the upper case 1 is significantly reduced. In addition, a short circuit or corrosion of the contact portions or electronic components due to ingress of the liquid can be suitably prevented, whereby operational reliability of the switch device can be ensured. Also, since the rotation shafts 8*b* formed on the operation knob 8 are snap-fitted into the through-holes 11*b* defined in the mounting frame 11 on a portion of the upper case 1 which mounting frame 11 has a relatively great strength, when compared with an installation structure in which shafts formed on a case are fitted into holes defined in an operation knob, it is easy to secure a mechanical strength of the operation knob 8. Moreover, since the rotation shafts 8*b* of the operation knob 8 and the through-holes 11*b* of the mounting frame 11 are not exposed to the outside, it not necessary to separately provide a member for covering the through-holes 11*b*, whereby an aesthetic outer appearance and miniaturization of the switch device can be accomplished.

Further, in the switch device according to the present invention, since the fact that the partition wall 12 is formed between two adjacent mounting frames 11 which are located in parallel on the upper surface of the upper case 1, and the gap between the partition wall 12 and the adjacent operation knob 8 is established to be significantly narrow, mis-operation of the operation knob 8 can be prevented by the partition wall 12, and the widthwise dimension of the upper case 1 is decreased, so that miniaturization of the switch device is enabled. That is to say, when an unintentional force is applied to the operation knob 8 such as when an elbow of an operator comes into contact with the operation knob 8, due to the presence of the partition wall 12, the operation knob 8 is prevented from being erroneously pressed, whereby safety can be improved. Further, even when a gap between two adjacent operation knobs 8 which are installed in parallel is decreased, due to the presence of the partition wall 12 between them, it is possible to clearly distinguish the respective operation knobs 8 through a finger's touch. Moreover, since the lower end of the side wall 8*a* of the operation knob 8 which faces the partition wall 12 is formed with the tapered portion 8*c* and this tapered portion 8*c* does not substantially increase the widthwise size of the operation knob 8 even when the corresponding side wall 8*a* is bent outward during installation of the operation knob 8, the gap between the partition wall 12 and the side wall 8*a* of the operation knob 8 which faces the partition wall 12 can be remarkably decreased, whereby it is possible to simply and reliably install the operation knob 8 on the mounting frame 11 and accomplish miniaturization of the entire switch device.

In the present embodiment, the tapered portion 8*c* is also formed on the lower end of the side wall 8*a* which does not face the partition wall 12. This is to ensure common use of the operation knobs 8 and to contribute to the reduction of manufacturing cost.

While it was described in the present embodiment that a movable element includes the slider 7 and the cam member 6, at least one of these component portions can be omitted as occasion demands, or other known component portions can be used without departing from the scope and spirit of the present invention.

According to the rocking operation type electric component of the invention, due to the fact that the pair of rotation shafts formed on the inner wall portions of the operation knob which face each other are snap-fitted from the outside of the mounting frame into the pair of through-holes which are provided in the mounting frame protrusively formed on the case, a mounting structure in which the operation knob for covering the mounting frame is rotatably supported by the mounting frame is adopted. Therefore, the possibility of the liquid such as rain water or beverage to leak into the case is significantly reduced, and it is easy to secure a mechanical strength of the operation knob, whereby a rocking operation type electric component having improved operational reliability can be obtained. Also, since the rotation shafts of the operation knob and the through-holes of the mounting frame are not exposed to the outside, an aesthetic outer appearance of the rocking operation type electric component can be provided.

In particular, in the construction in which the partition wall is protrusively formed between the two mounting frames which are located in parallel, the front end portion of the side wall of the operation knob which side wall faces the partition wall has the tapered portion which is gradually tapered to be decreased in its thickness so that the gap between the partition wall and the front end portion of the side wall of the operation knob is gradually increased. Therefore, since the gap between the partition wall and the side wall of the operation knob which faces the partition wall can be remarkably decreased, it is possible to simply and reliably install the operation knob on the mounting frame and accomplish miniaturization of the entire electric component, as a result of which a rocking operation type electric component appropriate to a power window mechanism for a motor vehicle can be obtained.

The invention claimed is:

1. A rocking operation type electric component comprising:

an operation knob that has a bottomed case-shaped configuration and is rockably held;

a signal generating unit that includes a movable element pressed and driven by the operation knob and generates a different electric signal in response to a position change of the movable element; and a case on which a mounting frame for pivotally supporting the operation knob is protrusively provided formed and in which the signal generating unit is received, wherein a pair of rotation shafts which face each other are protrusively formed on inner wall portions of the operation knob, respectively, through-holes are respectively formed in a pair of wall portions of the mounting frame which face each other, and the rotation shafts are fitted into the through-holes from the outside of the mounting frame to be rotatably supported by the mounting frames, wherein two mounting frames, which are located in parallel with surfaces having the through-holes adjacent each other, and a partition wall, which is located between the two mounting frames, are protrusively formed on the case, and at an opened end of the operation knob, a side wall facing the partition wall has a tapered portion that a front end portion gradually decreases in its thickness and a gap between the partition wall and the front end portion of the side wall of the operation knob gradually decreases.

2. The rocking operation type electric component according to claim 1, wherein the signal generating unit includes a plurality of movable contacts which are driven by the movable element, and a plurality of fixed contacts to and from which the movable contacts can be connected and disconnected.

* * * * *